United States Patent [19]

Yamada et al.

[11] 4,001,816

[45] Jan. 4, 1977

[54] ELECTRONIC CHIME

[75] Inventors: Kiyoshi Yamada; Kazushige Morisue, both of Hirakata; Hiroshi Shimomura, Ibaragi; Yoshio Imamura, Kusatsu, all of Japan

[73] Assignees: Matsushita Electric Works, Ltd.; Matsushita Electric Industrial Co., Ltd., both of Osaka, Japan

[22] Filed: Jan. 19, 1976

[21] Appl. No.: 650,450

[30] Foreign Application Priority Data

Jan. 21, 1975 Japan ..... 50-9587

[52] U.S. Cl. ..... 340/384 E; 340/384 R

[51] Int. Cl.[2] ..... G08B 1/00

[58] Field of Search ..... 340/384 E, 384 R; 179/110 A; 331/47; 310/8.5

[56] References Cited

UNITED STATES PATENTS 3,872,471 3/1975 Bird ..... 340/384 E

*Primary Examiner*—Harold I. Pitts

*Attorney, Agent, or Firm*—Leydig, Voit, Osann, Mayer & Holt, Ltd.

[57] ABSTRACT

An electronic chime wherein at least two different audible frequency signals forming chime sound are generated by a frequency divider oscillated by an oscillating circuit capable of adjusting its output standard frequency clock pulse. These audible frequency signals are respectively amplitude modulated so as to be attenuated stepwise, and the chime sound is generated by such modulated signals and caused to disappear at attenuated state.

10 Claims, 10 Drawing Figures a
b
c
d
e
f
g
f2
f1
Vcc
R61
R62
Tr61
C61
F
B
21
R27
R25
Tr24
Tr21
R21
D21
R26
Tr22
R23
20
R22
Tr23
R24
A
D11
R12
R11
C11
I
Tr33
Tr35
Tr36
Tr34
Tr32
Tr31
VR2
C31
C
FF41
FF42
FF43
FF44
FF45
FF46
FF47
NOT41
NOT42
NOT43
NOT44
NOT45
NOT46
D
PB1

E
FF50
FF51
FF52
FF53
FF54
FF55
FF56
FF57
FF58
FF59
C55
C56
C57
C58
C59
a
b
c
d
e

AMP
SP
VR1
J
Tr75
R74
Tr74
R79
Vcc
R78
R77
R76
R75
Tr73
R73
Tr72
R72
Tr71
G
83
NOT83
NOT84
NOT82
NOT81
f3
82
81
H
f
g

Vcc
Vcc
Vcc

ELECTRONIC CHIME

BACKGROUND OF THE INVENTION

This invention relates to electronic chimes and, more particularly, to improvements in chimes including electronic circuit for producing signalling chime sound of at least two different and sequential sounds upon actuation of calling push button.

Various circuits have been already suggested for electronic chimes. For example, such circuit as shown in FIG. 1 has been used, in which a current source A′ is connected through a calling push button PB with an electronic signalling circuit ES for producing audible frequency signals of at least the two sounds, and a speaker SP′ is connected to the circuit ES so that the speaker will be sounded by an ON-signal of the calling push button but, in the case of electronic chimes of which signalling chime sound has a fixed cycle, there is a defect that a time point in the cycle at which the chime sound stops cannot be fixed. FIGS. 2 and 3 show frequency wave forms gradually attenuated of a chime sound that has a fixed cycle. In case the sound stops, as in FIG. 2, after the completion of such fixed cycle of the chime sound consisting of a high sound HS and a low sound LS, the sound will become natural but, in case the push button is switched on at a time $t_1$ and is switched off at a time $t_2$ intermediate the low sound period, the low sound will be interrupted on the way as shown in FIG. 3 and the sound will become unpleasant or somewhat unnoticeable.

Also, such an electronic signalling circuit as is shown in FIG. 4 has been conventionally used. In this circuit, condensers $C_1$ and $C_2$ of an oscillating circuit and condensers $C_3$ and $C_4$ of an attenuating circuit are included so that two different sounds will be generated respectively at ON and OFF strokes of the push button PB so as to be gradually attenuated. In this case, too, there are defects that, as these condensers are connected as external parts of a semiconductor integrated circuit, the number of their connecting pins increases, there is no effect on the manufacture and use of the semiconductor integrated circuit; that, as the condenser $C_3$ must be charged during the waiting time when the push button PB is opened and its discharge current must be consumed, it is necessary to always impress a current source voltage Vcc on the circuit, there is an electric power consumption when the circuit is not used, the arrangement is therefore not adapted to the use of a battery power source; that the sounds consist of two sounds utilizing the charge and discharge of the condensers at the time of switching on and off of the calling push button PB and, in order to obtain a chime sound consisting of more than two different sounds, there must be separately provided a circuit consisting of a contact repeatedly switched on and off or a switching transistor and an oscillator and so on so as to render the circuit complicated and bulky. The present invention has been suggested to remove such defects as above.

SUMMARY OF THE INVENTION

According to the present invention, the above described problems have been successfully solved by forming the device in such that at least two kinds of audible frequency signals in a relation of a fixed ratio to each other and forming a chime sound or different chime sounds are generated by means of a frequency divider means which is oscillated by an oscillating circuit in which a standard frequency is adjustable and the chime sound of which amplitude is so modulated that each of these audible frequencies will attenuate stepwise is generated so that the chime sound will be cut off when the same is substantially completely attenuated, that is, always at the end of predetermined chiming cycle or cycles.

A primary object of the present invention is, therefore, to provide an electronic chime which can avoid any unnatural stop of the chime sound during its signalling operation.

Another object of the present invention is to provide an electronic chime which can continuously repeatedly signal a predetermined number of chime sound or sounds which consisting of at least two different sounds responsive to one actuation of calling push button.

A further object of the present invention is to provide an electronic chime which is capable of varying as desired the repetition frequency of at least two different sounds forming harmonic chime sound during each chiming cycle so as to produce chime sounds of different rhythms.

Yet further object of the present invention is to provide an electronic chime that allows to increase the number of calling push button as required and produce chime sounds of different rhythms depending on particular one of the push buttons actuated by a visitor.

A further object of the present invention is to provide an electronic chime which normally does not consume the energy of a current source while the calling push button is not operated.

Another object of the present invention is to provide an electronic chime in which, even the respective frequencies of the constituent sounds of the chime sound may be varied over a wide range, harmonized tone quality of the chime sound will not be impaired.

A yet another object of the present invention is to provide an electronic chime having a crime sound generating circuit which is adaptable to the semiconductor integration technique.

BRIEF DESCRIPTION OF THE DRAWINGS

Other objects and advantages of the present invention will be readily understood from the following disclosures detailed with reference to certain preferred embodiments of the present invention shown in accompanying drawings, in which.

DESCRIPTION OF THE PREFERRED EMBODIMENT

Figure 5:
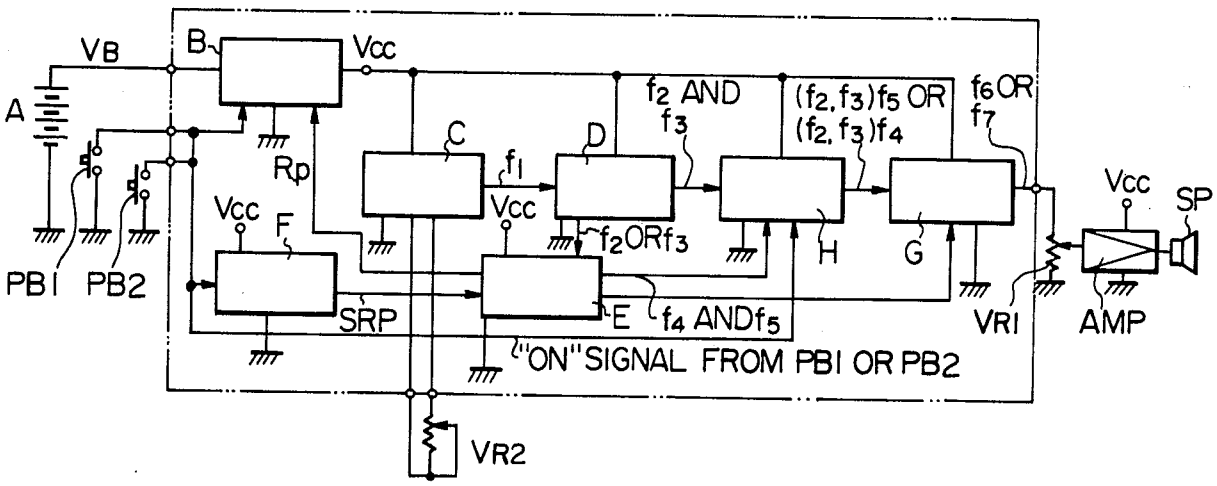
FIG. 5 is a block diagram of an embodiment of electronic chime according to the present invention.

Referring first to the preferred embodiment of the present invention shown in FIG. 5 in the form of a block diagram, there is shown an electronic chime provided with two calling push button PB1 and PB2 which will be installed at two different positions such as front and back doors of a house or office building and, in the particular embodiment, the chime is adapted to generate a chime sound of two different rhythms responsive to an actuation of either one of the push buttons, while this is not the primary object of the invention. In the drawing, a direct current source A such as a battery has a source voltage $V_B$ and this voltage is applied to a switching circuit B. This switching circuit B has a function of providing a fixed supply voltage Vcc to such respective circuits described in the following as, for example, an oscillating circuit, audible frequency signal generating frequency divider and others with a setting signal generated when the calling push button PB1 or PB2 is pushed and interrupting this supply voltage Vcc with a resetting signal, and is adapted to continuously feed the supply voltage Vcc to the respective circuits even when the push button PB1 or PB2 is released after the circuit is once set.

Figure 6:
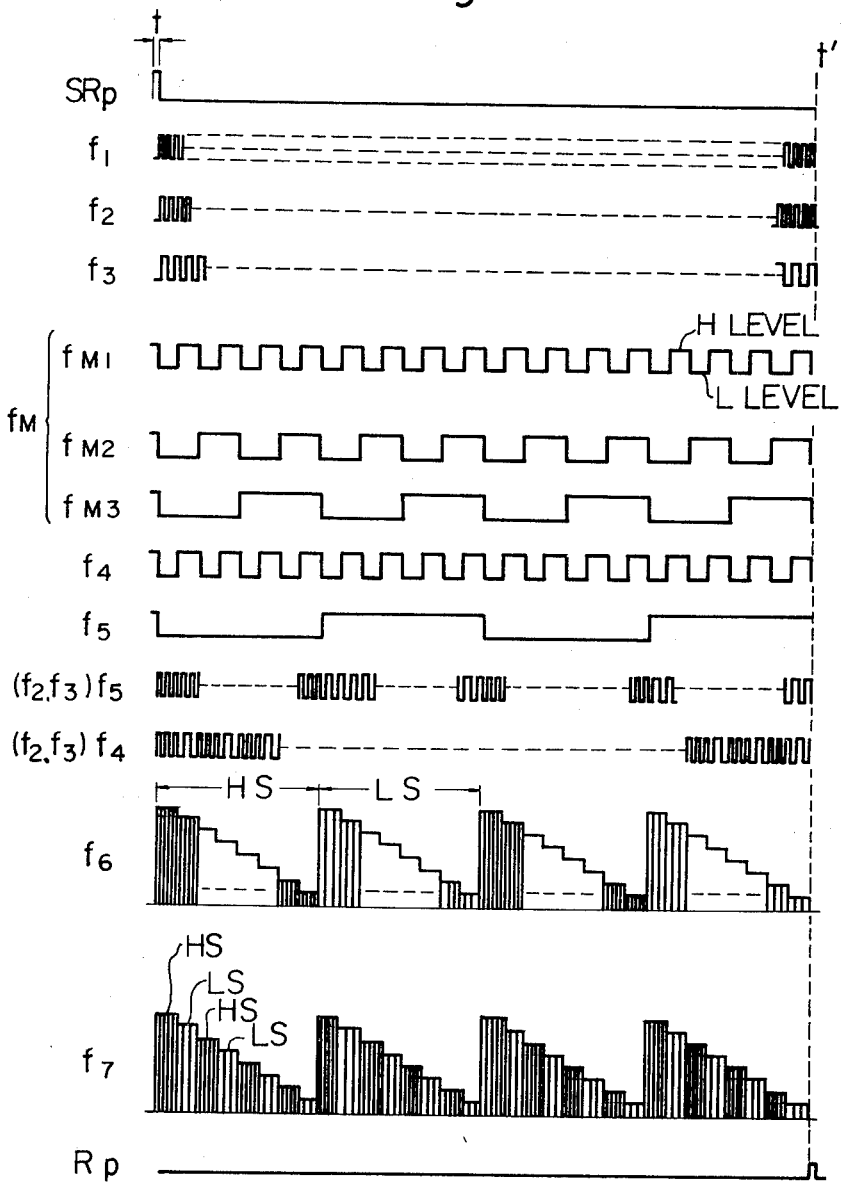
FIG. 6 is an explanatory view showing wave forms of respective signals employed in the circuit of FIG. 5.

An oscillating circuit C is connected to the switching circuit B to generate, when the voltage Vcc is given, a clock pulse of standard frequency $f_1$ for oscillating next stage frequency dividers (see diagram $f_1$ in FIG. 6). This standard frequency clock pulse $f_1$ is made variable optionally by means of, for example, a variable resistor $V_{R2}$. The output of the circuit C is given to the next stage frequency dividers, specifically to a first frequency divider D.

The first frequency divider D generates audible frequency signals of rectangular waves of frequencies $f_2$ and $f_3$ (see FIG. 6) with an input of the clock pulse $f_1$, and these generated audible frequency signals $f_2$ and $f_3$ are of two different frequencies such as, for example, $f_2 = 880$ Hz and $f_3 = 704$ Hz, that is, at a fixed ratio of $f_2:f_3 = 5:4$ which is known to be generally most suitable for a pleasant harmony of two sounds.

A second frequency divider E is provided at a further next stage to the divider D and the second frequency divider E is operated by applications the audible frequency signal $f_2$ or $f_3$ from the first frequency divider D and the supply voltage Vcc from the switching circuit B upon actuation of the push button PB1 or PB2 and generates, upon receiving an output $SR_P$ from an initial condition determining circuit F, a signal of a frequency $f_4$ or $f_5$ divided further out of the frequency $f_2$ or $f_3$, a signal $f_M$ consisting of three different frequency signals $f_{M1}$ to $f_{M3}$ for controlling a digital modulator G and a resetting pulse signal $R_P$ for resetting the switching circuit B to interrupt its supply voltage Vcc (see respective diagrams in FIG. 6).

The digital modulator G performs an amplitude modulation of an output from a later described selective controlling circuit H so as to attenuate the same stepwise responsive to the signals $f_{M1}$, $f_{M2}$ and $f_{M3}$ from the second frequency divider E. This amplitude modulated signal is amplified by an amplifier AMP and is converted to a chime sound by a speaker SP.

The selective controlling circuit H generates a signal which alternately repeating at a predetermined cycle the different frequency signals $f_2$ and $f_3$ from the first frequency divider D during each cycle of the chime sound. The rhythm of the chime sound with the thus alternately repeated two sounds is varied by the repeating cycle and, if this repeating cycle can be selectively determined depending on which one of the calling push buttons PB1 and PB2 is actuated in a manner described later, it is readily possible to discriminate the location of a visitor depending on a particular rhythm of the chime sound.

The amplifier AMP is to amplify the output from the digital modulator G responsive to such signal from the selective controlling circuit H as disclosed above so as to have the signal converted by the speaker SP to the chime sound. Its amplifying rate is preferably varied by the variable resistor $V_{R1}$ inserted between the modulator G and the amplifier AMP so that the volume of chime sound may be properly selected.

The operation of the electronic chime of FIG. 5 according to the present invention shall now be detailed in the following.

Even if either of the calling push buttons PB1 and PB2 is actuated, the fundamental operation of the circuit arrangement will be substantially the same and, therefore, the operation in the case when the push button PB1 is actuated only shall referred to here for the purpose of brevity. With the ON-signal from the push button PB1, the switching circuit B will be set and the supply voltage Vcc will be fed to all of the respective elements B through H and amplifier AMP and, even when the push button PB1 is released to be switched off, the voltage Vcc will be retained as fed through the whole circuit during a predetermined number of chiming cycles, which being two cycles in the present embodiment of FIGS. 5 and 6. Only when the resetting pulse signal $R_P$ is provided by the second frequency divider E to the switching circuit B at the end of the predetermined number of chiming cycles which is dependent on the number of, for example, logic elements forming the second frequency divider E, the switching circuit B is switched off to stop the supply voltage Vcc.

Now, responsive to the ON-signal from the push button PB1, the initial condition determining circuit F will generate a one-shot-resetting pulse SRP (see diagram SRP in FIG. 6), which pulse is presented to the second frequency divider E so as to set an output of a predetermined one of the logic elements in the second frequency divider E to be high (H) level.

When the supply voltage Vcc is fed to the oscillating circuit C, the same will generate an output of the frequency $f_1$ (preferably about 7 KHz), this output frequency will be divided by the first frequency divider D into the two signals of different audible frequencies $f_2$ and $f_3$. The thus generated frequencies $f_2$ and $f_3$ are preferably $f_2 \approx 880$ Hz and $f_3 \approx 704$ Hz, that is, preferably at a ratio of $f_2:f_3 = 5:4$. When the second frequency divider E is oscillated by either of these different frequency signals $f_2$ and $f_3$, there will be obtained controlling signals of rectangular waves $f_4$ and $f_5$ and modulating signals $f_{M1}$, $f_{m2}$ and $f_{M3}$ respectively to be provided to the selective controlling circuit H and digital modulator G. In the present case, the frequencies of the respective signals $f_4$, $f_5$ and $f_{M1}$ to $f_{M3}$ will be preferable $f_4 \approx 16$ Hz, $f_5 \approx 2$ Hz, $f_{M1} \approx 16$ Hz, $f_{M2} \approx 8$ Hz and $f_{M3} \approx 4$ Hz.

Responsive to the On-signal of the calling push button PB1, on the other hand, the selective controlling circuit H will alternately generate signals corresponding respectively to the signals $f_2$ and $f_3$ from the first frequency divider D, which are provided to the next digital modulator G. The cycle of these alternately generated signals by the circuit H is determined, in the present instance, by the signal $f_5$ from the second frequency divider E and, thus, such output is represented by $(f_2, f_3)\, f_5$. This output $(f_2, f_3) f_5$ will be applied to the digital modulator G and amplitude-modulated therein by the signals $f_{M1}$, $f_{M2}$ and $f_{M3}$ from the second frequency divider E so as to be attenuated stepwise as described later and such signal as represented by $f_6$ in the diagram of FIG. 6 will be provided and amplified by the amplifier AMP so as to be sounded from the speaker SP. With the signal shown by the frequency $f_6$, in the present instance, such two cycle chime sound of two trailing sounds as "pi-n po-n, pi-n po-n" will be produced, wherein "pi-n" is a high sound (HS) and "po-n" is a low sound which are respectively gradually attenuated.

In the case when the other calling push button PB2 is actuated to provide the ON-signal, the output of the second frequency divider E that determines the repeating cycle of the two frequency signals $f_2$ and $f_3$ at the selective controlling circuit H is the frequency signal $f_4$, so that the output from the circuit H will be $(f_2, f_3)\ f_4$, whereby the output frequency from the digital modulator G becomes $f_7$. Consequently such two cycle chime sound of repetitive and gradually attenuated two short sounds as "pi po pi po . . . ., pi po pi po . . . ." will be produced.

Thus the respective chime sounds of the two different rhythms having the modulated wave forms $f_6$ and $f_7$ are generated selectively in accordance with the particular one of the two calling push buttons PB1 and PB2 actuated in the present embodiment and, if desired, more than two of the push buttons may be provided and the device may be readily adapted to produce corresponding number of varying rhythms of the chime sound selectively depending on actuated push button by properly arranging or setting a program of the constituent elements of the second frequency divider E, so that some other frequency signal or signals than the signals $f_4$ and $f_5$ for eventually determining the mode of the chime sound rhythm will be provided by the second frequency divider E.

Thus the repetition frequency of the two audible frequency signals $f_2$ and $f_3$ in each chiming cycle is determined by the signals $f_4$ and $f_5$ so that a particular mode of the chime sound rhythm will be selectively chosen. On the other hand, the number of the chiming cycle or cycles for which the chime sound is to be generated or, in other words, how many times the chime sound should be repeated, may be also selectively determined by the number of the constituent elements of the second frequency divider E so that the timing at which the resetting pulse signal $R_P$ is to be provided from the second frequency divider E to the switching circuit B will be determined. In any event, according to the present invention, the resetting pulse signal $R_P$ is provided only when the modulated wave $f_6$ or $f_7$ reaches the last attenuated step at the end of the predetermined number of chiming cycle or cycles so that the chime sound will terminate always at the time when the sound is substantially completely attenuated.

While the mode of the chime sound rhythm is varied as described above depending on the modulation mode determining signals $f_4$ and $f_5$ from the second frequency divider so that the mode will take either one of the modulated wave forms $f_6$ and $f_7$, it will be noticed that the tone of the chime sound thus produced does not vary even the rhythm is varied. On the other hand, the present invention enables it possible to easily vary the tone by selectively adjusting resistance value of the variable resistor $V_{R2}$ connected to the oscillating circuit C so that the output frequency $f_1$ of the circuit C to the first frequency divider D will be varied. However, it will be appreciated that the ratio $f_2$:$f_3$ of the audible frequencies is not to be varied even the frequency $f_1$ is varied and consequently the harmonized tone of the two sounds sequentially produced as the chime sound does not vary. In the present instance, this audible frequency ratio is set to be 5:4 as described before, which being known to be most suitable for generating a pleasant harmonized tone of two sounds, and as long as this ratio is retained unchanged a wide range adjustment of the tone of the chime sound is made possible without impairing the sound's pleasantness.

Figures 7A, 7B:
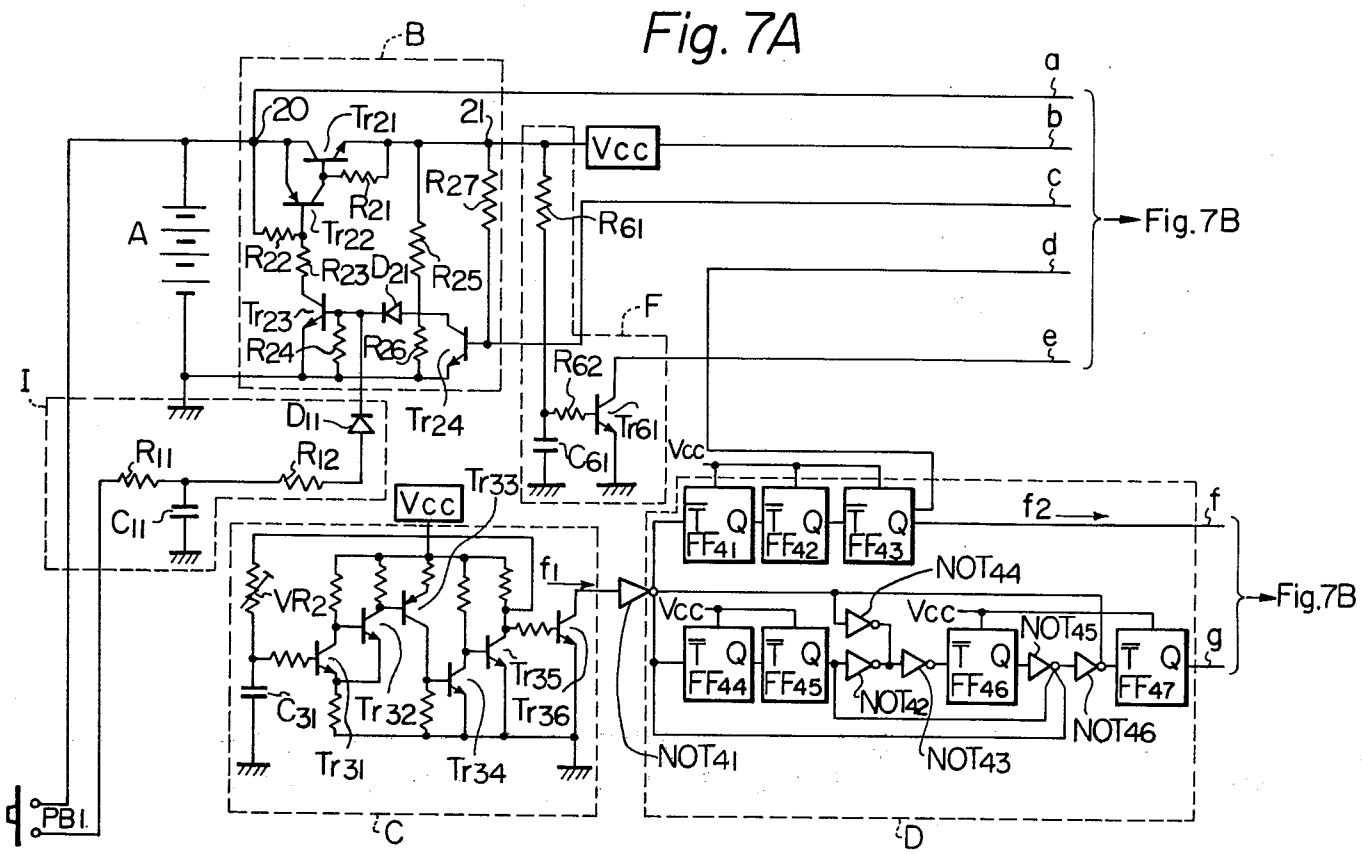
FIGS. 7A and 7B show jointly a circuit diagram of a practical embodiment of the electronic chime according to the present invention.
Figures 7A, 7B:
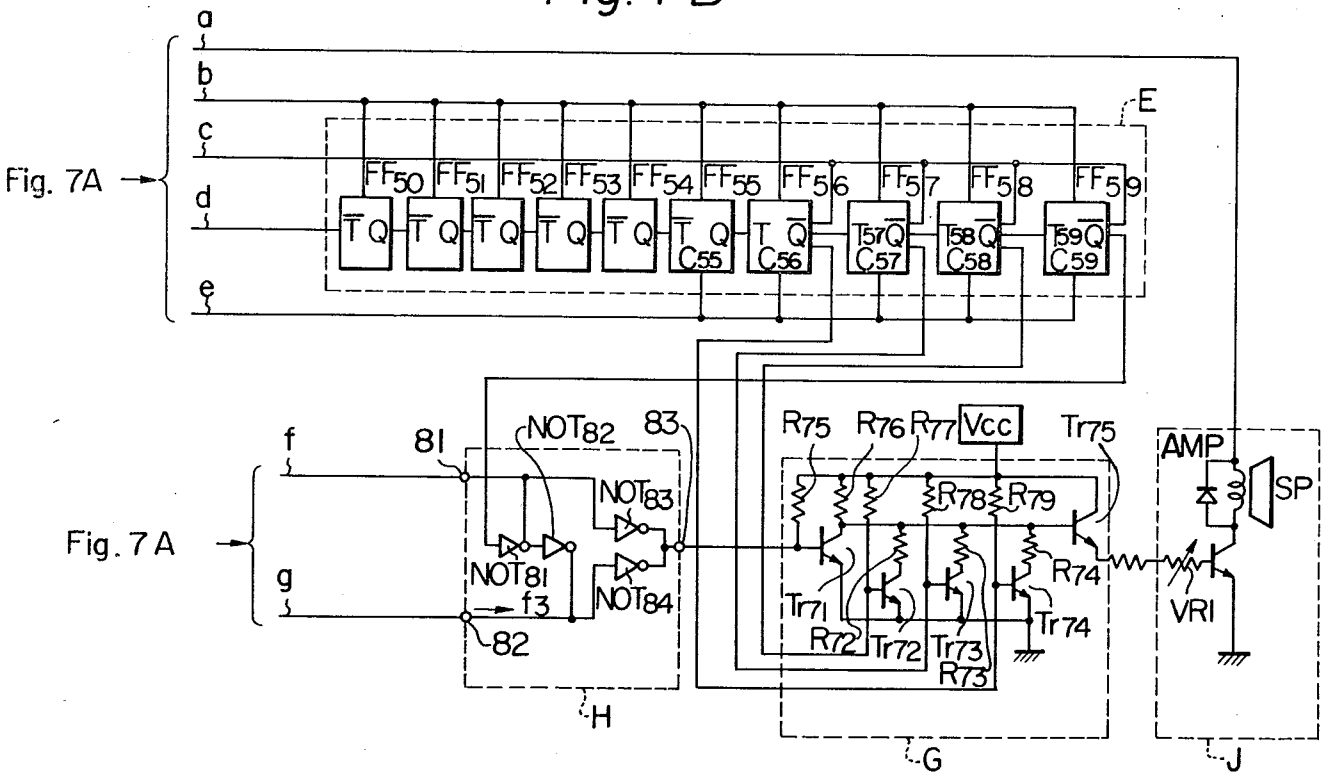

In the practical embodiment as shown in FIGS. 7A and 7B jointly, there are shown exemplary circuit arrangements for the respective elements A through H as shown in and described with reference to FIG. 5 of the device. Thus the respective elements encircled by broken lines are given the same references A through H and the operational relations between them are the same as disclosed with reference to FIGS. 5 and 6.

The entire arrangement of the embodiment in FIGS. 7A and 7B is adaptable to the use of either a single calling push button and two calling push buttons and, in the particular case of FIGS. 7A and 7B, an example of the use of a single calling push button PB1 shall be referred to for the purpose of brevity of the specification.

In adapting the device comprising the elements A through H as well as the amplifier AMP and speaker SP as shown in FIGS. 7A and 7B to the number of the calling push button employed, the purpose will be readily achieved by inserting a suitable input circuit between the push button or buttons and the power source A and switching circuit B and also properly arranging the circuitry elements of the selective controlling circuit H. This will be easily noticed when the arrangement of FIGS. 7A and 7B is compared with that of later disclosed embodiment of FIGS. 8A and 8B in which two calling push buttons are employed. The respective circuit arrangements of the second frequency divider E and selective controlling circuit H are adapted in the present instances to the production of the chime sound of which the rhythm may be varied to two modes and of which chiming cycle is two with an actuation of the push button, similar to the case of FIGS. 5 and 6.

Referring now to the embodiment of FIGS. 7A and 7B, an input circuit I is connected to the push button PB1 and to the battery power source A and switching circuit B. The input circuit I comprises two series resistors $R_{11}$ and $R_{12}$, a condenser $C_{11}$ connected at an end to the connecting point of said two resistors and earthed at the other end, and a diode $D_{11}$ connected with said resistor $R_{12}$. When the push button PB1 is closed, the voltage of the battery A will be applied as a setting signal through the call button PB1, resistors $R_{11}$ and $R_{12}$ and diode $D_{11}$ to the base of a transistor $T_{r23}$ in the switching circuit B of the next stage.

The switching circuit B has an input terminal 20 and output terminal 21. The collector of a transistor $T_{r21}$ is connected with said input terminal 20. The emitter of the transistor $T_{r21}$ is connected with the output terminal 21. A resistor $R_{21}$ is connected between the base and emitter of said transistor $T_{r21}$. The collector of a transistor $T_{r22}$ is connected with the base of the transistor $T_{r21}$. The emitter of a transistor $T_{r22}$ is connected with the collector of the transistor $T_{r21}$. A resistor $R_{22}$ is connected between the base and emitter of the transistor $T_{r22}$. The emitter of a transistor $T_{r23}$ is earthed, the collector is connected with a resistor $R_{23}$, the base is connected with the diode $D_{11}$, a resistor $R_{24}$ is connected between the base and emitter and the other end of the resistor $R_{23}$ is connected with the base of the transistor $R_{r22}$. The collector of a transistor $T_{r24}$ is connected with the base of the transistor $T_{r23}$ through a diode $D_{21}$, the emitter is earthed and the resetting signal $R_P$ from the second frequency divider E in the later stage is given to the base. Resistors $R_{25}$ and $R_{26}$ are connected in series and are connected at the other ends with the emitter of the transistor $T_{r21}$ and at the connecting point of both resistors with the collector of the transistor $T_{r24}$. A resistor $R_{27}$ is connected between the base of the transistor $T_{r24}$ and the output terminal 21.

The operation of the switching circuit B shall be described in the following. The transistors $T_{r21}$ and $I_{r22}$ are to form a series switching circuit. The transistors $T_{r23}$ and $T_{r24}$ are to control the transistor $T_{r22}$ to be on and off. When the push button PB1 is closed to apply a + voltage to the base of the transistor $T_{r23}$, said transistor will conduct, the transistors $T_{r22}$ and $T_{r21}$ will conduct and the voltage Vcc will appear at the output terminal 21. Even if the button PB1 is switched off, the base current of the transistor $T_{r23}$ will be fed through the resistor $R_{25}$ and diode $D_{21}$ from the emitter of the transistor $T_{r21}$ and said transistor $T_{r21}$ will be kept switched on. As will be described later, in the second frequency divider E, when the outputs of Q terminals of flip-flops $FF_{56}$ to $FF_{59}$ are all made to be high (H) level, the transistor $T_{r24}$ will be switched on, the emitter current from the transistor $T_{r21}$ will flow through the resistor $R_{25}$ and transistor $T_{r24}$ and, therefore, the base potential of the transistor $T_{r23}$ will become zero and will be switched off. Therefore, both transistors $T_{r22}$ and $T_{r21}$ will be switched off and the voltage Vcc will be cut off.

The oscillating circuit C shall be explained in the following. Transistors $T_{r31}$, $T_{r32}$, $T_{r33}$, $T_{r34}$ and $T_{r35}$ are all forming an amplifying circuit for a positive feedback. The variable resistor $V_{R2}$ for varying the tone of the chime sound is inserted in the feedback circuit so that the output oscillation frequency $f_1$ will be varied by varying this resistor. A transistor $T_{r36}$ is to amplify the oscillation output.

The first frequency divider D for generating the audible frequency signals comprises two series of flip-flops $FF_{41}$ to $FF_{47}$, as the logic elements. The first frequency divider D has two lines to convert the input frequency signal $F_1$ to the audible frequencies $f_2$ and $f_3$. The outputs of the flip-flops $Ff_{41}$, $FF_{42}$ and $FF_{43}$ are made to be given to flip-flops in the next stage. The input signal of the frequency $f_1$ will not be given to the flip-flop $FF_{41}$ through an inverter $NOT_{41}$ and a signal of the frequency $f_2$ divided to be ⅛ by will be obtained from the flip-flop $FF_{43}$.

The circuit including the flip-flops $FF_{44}$ to $FF_{47}$ and inverters $NOT_{42}$ to $NOT_{46}$ is forming a known 1/10 frequency dividing circuit, and a signal of the frequency $f_3$ divided to be 1/10 will be obtained from the flip-flop $FF_{47}$.

In this embodiment, $f_1 = 7.04$ KHz, $f_2 = 880$ Hz, $f_3 = 704$ Hz and $f_2:f_3 = 5:4$.

The second frequency divider E is to further divide, in the present instance, the audible frequency signal $f_2$ from the first frequency divider D with its flip-flops to generate the resetting pulse signal $R_P$ to the switching circuit B, respective controlling signals $f_{M1}$ to $f_{M3}$ to the digital modulator G and rhythm mode determining signal $f_5$ in the present instance to the selectively controlling circuit H. $FF_{50}$ to $FF_{59}$ represent the respective flip-flops which are so connected that the outputs of them in the front stage will be given respectively to the flip-flops in the next stage. $C_{55}$ to $C_{59}$ are clearing terminals of the latter stage flip-flops $FF_{55}$ to $FF_{59}$ and, when the one-shot resetting pulse $SR_P$ is provided to these terminals from the initial condition determining circuit F, the flip-flops $FF_{55}$ to $FF_{59}$ will be cleared. The Q terminals of the flip-flops $FF_{56}$ to $FF_{59}$ are all connected with the base of the transistor $T_{r24}$ in the switching circuit B while the $\overline{Q}$ terminals of the flip-flops $FF_{56}$ to $FF_{58}$ are connected respectively to the bases of transistors $T_{r74}$, $T_{r73}$ and $T_{r72}$ in the digital modulator G, and the $\overline{Q}$ terminal of the flip-flop $FF_{59}$ only is connected to an inverter $NOT_{81}$ in the selective controlling circuit H to provide the signal $f_5$.

The digital modulator G is formed in such that a transistor $T_{r71}$ will act as an amplifying transistor so that the output from the selective controlling circuit H in the front stage will be provided thereto, the collector of which transistor is connected to the base of an output transistor $T_{r75}$ and the emitter is earthed. The collectors of transistors $T_{r72}$, $T_{r73}$ and $T_{r74}$ are connected to the base of the output transistor $T_{r75}$ respectively through resistors $R_{72}$, $R_{73}$ and $R_{74}$ and their emitters are respectively earthed. $R_{75}$ to $R_{79}$ are respectively resistors having the supply voltage Vcc given at one end and connected at the other ends respectively to the base and collector of the transistor $T_{r71}$ and the bases of the transistors $T_{r72}$, $T_{r73}$ and $T_{r74}$. Preferably the resistance value of the resistor $R_{74}$ is twice as high as of the resistor $R_{73}$ and the resistance value of the resistor $R_{73}$ is selected to be twice as high as of the resistor $R_{72}$ so that the stepped modulation waves $f_6$ or $f_7$ as in FIG. 6 will be obtained.

The operations of the second frequency divider E and digital modulator G shall be explained in the following. The terminals $\overline{Q}_{56}$, $\overline{Q}_{57}$, $\overline{Q}_{58}$ and $\overline{Q}_{59}$ of the flip-flops $FF_{56}$ to $FF_{59}$ in the frequency divider E correspond respectively to the signals $f_{M1}$, $f_{M2}$,$f_{M3}$ and $f_5$ in FIG. 6. When the calling push button PB1 is actuated, a clearing signal will be given to the terminals $C_{56}$, $C_{57}$, $C_{58}$ and $C_{59}$ of these flip-flops due to the generation of the one-shot resetting pulse $SR_P$ of the initial condition determining circuit F and the Q terminals of these flip-flops will be set to be the L level and $\overline{Q}$ terminal will be set to be the H level. In the period of $t$ of the signal $Sr_P$ (see FIG. 6), the terminals $\overline{Q}_{56}$ to $\overline{Q}_{59}$ will be all on the H level but, from the next moment, all of them will change to be on the L level. When L pulse enters the $\overline{T}$ terminal of the flip-flop $FF_{56}$ which was in H level, the terminal $\overline{Q}_{56}$ will change to be on the L level from the H level and the terminals $T_{57}$ to $T_{59}$ will also change to be on the L level from the H level in turn, so that the respective terminals $\overline{Q}_{57}$ to $\overline{Q}_{59}$ will be sequentially reversed. Consequently, the signals $f_{M1}$, $f_{M2}$, $f_{M3}$ and $f_5$ will appear respectively at the terminals $\overline{Q}_{56}$ to $\overline{Q}_{59}$. During the first half cycle of the signal $f_5$, the audible frequency signal $f_2$ is fed from the selective controlling circuit H to the digital modulator G, while from the second frequency divider E the respective signals $f_{M1}$, $f_{M2}$ and $f_{M3}$ are provided to the respective bases of the transistors $T_{r74}$, $T_{r73}$ and $T_{r72}$. Since these signals $f_{M1}$–$f_{M3}$ are all on L level initially, the transistors $T_{r74}$ –$T_{r72}$ will remain cut off so that the collector of the transistor $T_{r71}$ will oscillate at the frequency $f_2$ between the supply voltage Vcc and the ground. Then, as only the signal $f_{M1}$ becomes on the H level, only the transistor $T_{r74}$ will be on so that the collector of the transistor $T_{r71}$ will oscillate at the frequency $f_2$ with the voltage obtained by dividing the supply voltage Vcc with the resistors $R_{76}$ and $R_{74}$. Such operations are repeated in the sequence of the following table during a period corresponding to one cycle of the signal $f_{M3}$, so that the oscillation amplitude of the collector of the transistor $T_{r71}$ will be gradually attenuated.

| | | | | | | | | |
|---|---|---|---|---|---|---|---|---|
| $\overline{f_{M1}}$ ($Q_{56}$) | L | H | L | H | L | H | L | H |
| $\overline{f_{M2}}$ ($Q_{57}$) | L | L | H | H | L | L | H | H |
| $\overline{f_{M3}}$ ($Q_{58}$) | L | L | L | L | H | H | H | H |
| Bias resistance | ∞ | $R_{74}$ | $R_{73}$ | $R_{74}//R_{73}$ | $R_{72}$ | $R_{74}//R_{72}$ | $R_{73}//R_{72}$ | $R_{74}//R_{73}//R_{72}$ |

(In the table, $R_{74}//R_{72}$ represents that the resistors $R_{72}$ and $R_{74}$ are connected in parallel with each other.)

When the latter half cycle of the signal $f_5$ is reached, the audible frequency signal supplied from the selective controlling circuit H to the digital modulator G will be shifted to the signal $f_3$ in a manner as will be detailed later. With the respective signals $f_{M1}$–$f_{M3}$ from the second frequency divider E, the modulator G performs the same repetitive operations as described above, so that the collector of the transistor $T_{r71}$ will oscillate at the frequency of the signal $f_3$ with the similarly gradually attenuated amplitudes.

After the predetermined number of the repetitive operations as above is reached and the respective $\overline{Q}$ terminals of the flip-flops $FF_{56}$–$FF_{59}$ are all on the H level, that is, at the time represented by $t'$ in FIG. 6, the resetting pulse $R_P$ is provided from these terminals to the base of the transistor $Tr_{24}$ in the switching circuit B, so that the supply voltage Vcc to the respective circuits is interrupted.

The selectively controlling circuit H has an input terminal 81 to which the frequency $f_2$ is to be given and another input terminal 82 to which the frequency $f_3$ is to be given, and is adapted to provide alternately the signals of the respective frequencies $f_2$ and $f_3$ to an output terminal 83. The input terminal 81 is connected with an inverter $NOT_{83}$, the input terminal 82 is connected with an inverter $NOT_{84}$, and the output sides of the both inverters $NOT_{83}$ and $NOT_{84}$ are connected with the output terminal 83. Further, inverters $NOT_{81}$ and $NOT_{82}$ connected in series are inserted so that the inverter $NOT_{82}$ is connected with the inverter $NOT_{84}$ and the input side of the inverter $NOT_{81}$ is connected with the $\overline{Q}$ terminal of the flip-flop $FF_{59}$ in the second frequency divider E. Further, the connecting point of the inverters $NOT_{81}$ and $NOT_{82}$ is connected with the input terminal 81.

In the operation, when the output of the $\overline{Q}$ terminal of the flip-flop $FF_{59}$ is on the L level, the input terminal 81 will be on the H level and the input terminal 82 will be on the L level, so that only the terminal 81 will oscillate at the frequency $f_2$ and thus the signal $f_2$ will appear at the output terminal 83 through the inverter $NOT_{83}$. Then, in case the output of the $\overline{Q}$ terminal is on the H level, the signal $f_3$ will appear at the output terminal 83.

In the initial condition determining circuit F, a resistor $R_{62}$ and condenser $C_{61}$ are connected in series, while the resistor $R_{62}$ is connected with the output terminal 21 of the switching circuit B and the condenser $C_{61}$ is earthed at the other end. The connecting point of the resistor $R_{61}$ and condenser $C_{61}$ is connected with the base of a transistor $Tr_{61}$ through a resistor 62, the collector of this transistor is connected with the clearing terminals of the flip-flops $FF_{55}$ to $FF_{59}$ and the emitter is earthed.

When the supply voltage Vcc is supplied to one end of the resistor $R_{61}$, the condenser $C_{61}$ will be charged through said resistor, the transistor $Tr_{61}$ will be opened until the charged voltage of the condenser $C_{61}$ becomes higher than a fixed value, the clearing terminals $C_{55}$ to $C_{59}$ of the flip-flops $FF_{55}$ to $FF_{59}$ will be on the H level and will be cleared, the respective Q terminals will be on the L level and the $\overline{Q}$ terminals will be on the H level. Then the transistor $Tr_{61}$ will conduct, the respective clearing terminals will be earthed and the respective flip-flops will be released from the clear state. The voltage $SR_P$ generated by this initial condition determining circuit F will be as shown in FIG. 6.

Figures 8A, 8B:
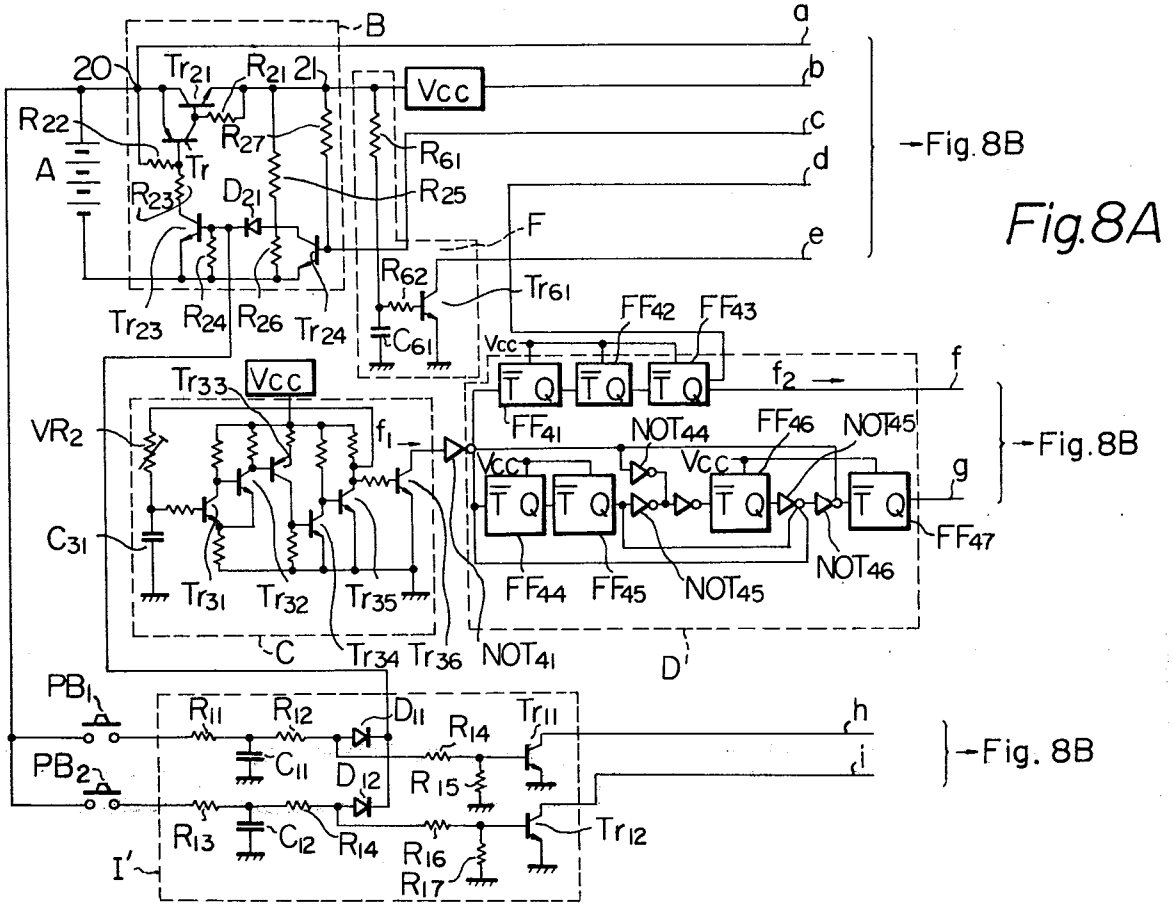
FIGS. 8A and 8B show jointly a circuit diagram of another practical embodiment of the present invention.
Figure 8B:
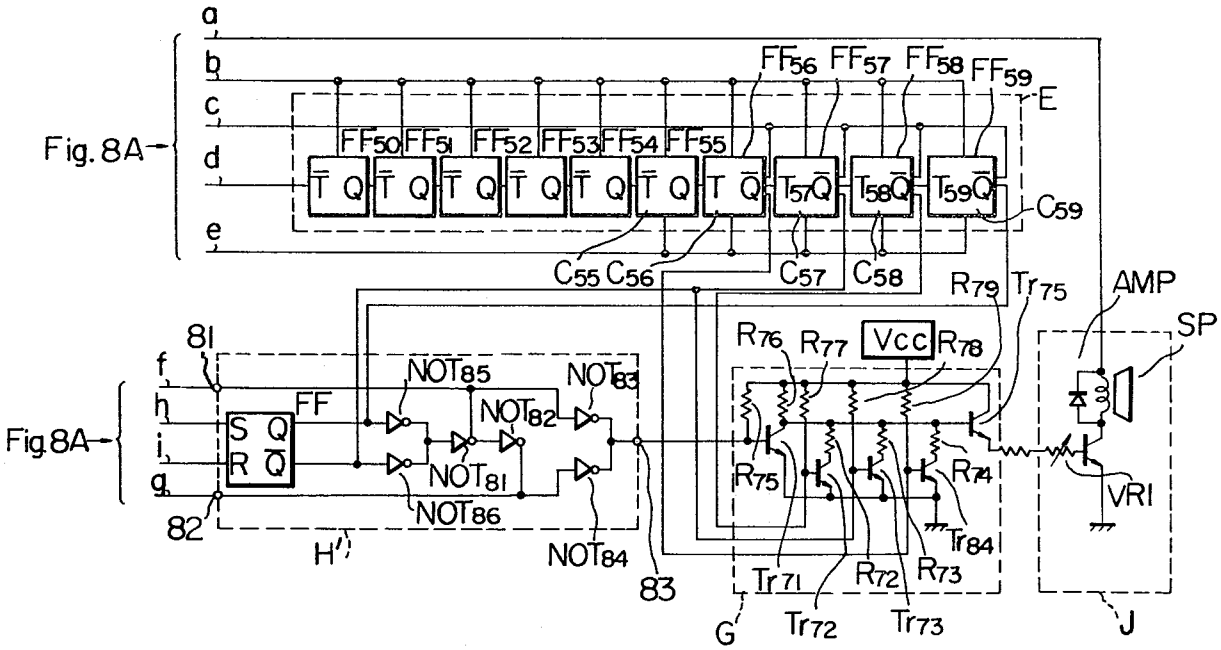

While in the foregoing the embodiment in which a single calling push button is employed has been disclosed with reference to FIGS. 7A and 7B, a further embodiment employing two calling push buttons in the substantially the same arrangement of FIGS. 7A and 7B with an exception that the input circuit I and selective controlling circuit H are modified so that the chime sound will be produced at the different rhythms depending on either one of the push buttons PB1 and PB2 is actuated, shall now be referred to with reference to FIGS. 8A and 8B.

In the device of FIGS. 8A and 8B, the respective circuits B through H are exactly the same as those in the corresponding circuits B through H and detailed explanations of them are omitted here.

The input circuit inserted between the two calling push buttons PB1 and PB2 and the power source A and switching circuit B is modified to be in the arrangement of I′ as shown in FIG. 8A so that a signal respresenting either particular one of the push buttons PB1 and PB2 will be provided. For this purpose, the base of a transistor $Tr_{11}$ is connected to the junction of the resistor $R_{12}$ and the diode $D_{11}$ in the same circuit of the input circuit I in the case of FIG. 7A connected with the push button PB1, through a resistor $R_{14}$ the junction of which with the base of the transistor $Tr_{11}$ is connected to an end of a resistor $R_{15}$ earthed at the other end. The emitter of the transistor $Tr_{11}$ is also earthed and the signal showing that the push button PB1 is actuated is to appear at the collector of the transistor $Tr_{11}$. Similar connections of resistors $R_{13}$ and $R_{14}$, diode $D_{12}$ and condenser $C_{12}$ and of resistors $R_{16}$ and $R_{17}$ and transistor $Tr_{12}$ are connected to the other push button PB2 connected in parallel to the push button PB1 so that the signal denoting an actuation of the push button PB2 will appear at the collector of the transistor $Tr_{12}$. Output side of the diode $D_{12}$ is also connected to the connecting point of the diode $D_{21}$ and Transistor $Tr_{23}$ in the switching circuit B.

In the selective controlling circuit H′ as shown in FIG. 8B, there is provided a flip-flop FF, of which input terminals S and R are connected with the collectors of the transistors $Tr_{11}$ and $Tr_{12}$, respectively, and output terminals Q and $\overline{Q}$ are connected to respective input sides of inverters $NOT_{85}$ and $NOT_{86}$. Output sides of these inverters are connected to the inverter $NOT_{81}$ in the same arrangement of the inverters $NOT_{81}$ through $NOT_{84}$ as in the selective controlling circuit H of FIG. 7B. In the present case, the $\overline{Q}$ terminals of the flip-flops $FF_{57}$ and $FF_{59}$ providing the signals $f_4$ and $f_5$, respectively, are connected to input sides of the inverters $NOT_{85}$ and $NOT_{86}$, respectively.

Now, when either one of the push buttons PB1 and PB2 is actuated, the switching circuit B is switched to be in ON state so that the supply voltage Vcc will be supplied to the entire circuit. At the same time, the transistor $Tr_{11}$ or $Tr_{12}$ in the circuit I′ is caused to become conductive responsive to the particular push button PB1 or PB2 actuated.

When the transistor $Tr_{11}$ is made ON, the terminal S of the flip-flop FF in the selective controlling circuit H is caused to be on the L level during the ON period of the transistor $Tr_{11}$ and the terminals Q and $\overline{Q}$ of this flip-flop will retain the H level and L level, respectively, even when the transistor $Tr_{11}$ becomes nonconductive. Thus, the input to the inverter $NOT_{81}$ is to be the signal $f_5$ from the $\overline{Q}$ terminal of the flip-flop $FF_{59}$ in the second frequency divider E, so that a signal in which the audible frequencies $f_2$ and $f_3$ are alternately appearing in the mode of the wave form $f_6$ as in FIG. 6 determined by the signal $f_5$ is obtained at the output terminal 83 of the selective control circuit H.

When the transistor $Tr_{12}$ is made to be ON, a signal in which the frequencies $f_2$ and $f_3$ are appearing in the mode of the wave form $f_7$ determined by the signal $f_4$ from the $\overline{Q}$ terminal of the flip-flop $FF_{57}$ is obtained at the output terminal 83, through substantially the same operation as above.

Figure 1:
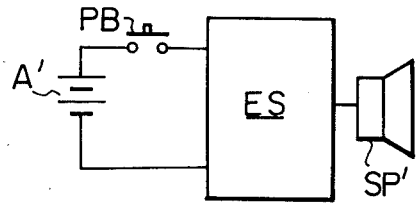
Fig. 1 (PRIOR ART)
FIG. 1 is a schematic circuit diagram of a conventional electronic chime.
Figure 2:
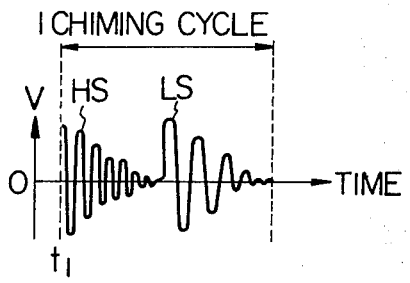
FIGS. 2 and 3 are explanatory diagrams of chiming sound frequency waves.
Figure 3:
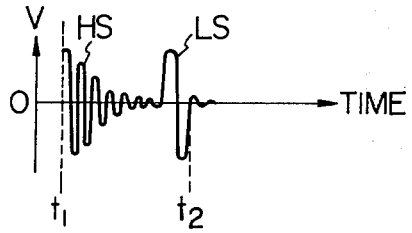
Figure 4:
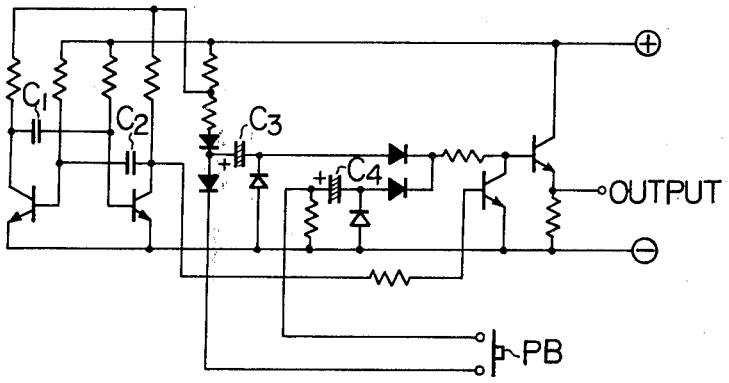
Fig. 4 (PRIOR ART)
FIG. 4 is a diagram of an electronic signalling circuit in another conventional electronic chime.

With the arrangement as has been disclosed, the present invention achieves the following features:

i. According to the present invention, the chime sound is kept produced until the resetting pulse is applied to the switching circuit B. This resetting pulse will be generated only when the outputs of the $\overline{Q}$ terminals of the flip-flops $FF_{56}$ to $FF_{59}$ forming the second frequency divider E have all come to be on the H level, that is, when the chime sound has been attenuated most, and, therefore, no unnatural stop of the chime sound will be caused so that no unpleasant sound will be given during the chime sound.

ii. In the present invention, two different audible frequency signals are generated by the first frequency divider D, which are alternately arranged by the selective controlling circuit H, and the repetition frequency of the chime sound comprising these alternately arranged audible frequencies is determined by the second frequency divider E, so that the repetition frequency of the chime sound to be generated by one actuation of the calling push button can be determined more freely than in the circuit in FIG. 4 with a simpler structure.

iii. According to the present invention, the electric source power is fed to the device circuit only when the calling push button is actuated and is caused to completely disappear by means of the resetting pulse at the end of chiming operation so that such current source as, for example, a dry cell can be used over a long time.

iv. In the present invention, the output from the standard frequency oscillator is made to generate two audible frequencies of a fixed ratio by the frequency divider and, therefore, even if the frequency of the output of the oscillator is varied, the ratio of two audible frequencies which form the chime sound will not vary and the chime sound not impairing the tone can be always generated.

v. According to the present invention, the resistors and condensers to be used are so few that the IC technique can be easily adopted and the apparatus can be made small.

What we claim as our invention is:

1. An electronic chime comprising:

a. a current source, b. at least a calling push button, c. a switching circuit connected to said current source and calling push button for feeding a supply voltage to all attached component circuits by an operation of said push button and interrupting said supply voltage upon receiving a resetting signal, d. an oscillating circuit for generating a standard frequency clock pulse upon receiving the supply voltage, e. a first frequency divider for generating at least two signals of different audible frequencies upon receiving said clock pulse from said oscillating circuit, f. an initial condition determining circuit for generating a one-shot pulse signal upon actuation of the push button, g. a second frequency divider receiving said at least two signals from said first frequency divider and one-shot pulse signal from said initial condition determining circuit and generating at least a rhythm determining pulse signal and a plurality of digital modulation signals, and further generating a resetting pulse to be applied to said switching circuit, h. a selective controlling circuit receiving said audible frequency signals from said first frequency divider and said rhythm determining pulse signal from said second frequency divider to alternately arrange the audible frequency signals at a rhythm determined by the rhythm determining pulse signal, i. a digital modulator for modulating said alternately arranged audible frequency signals from said selectively controlling circuit in response to said plurality of digital modulation signals from the second frequency divider, j. an amplifier for amplifying said modulated signals from said digital modulator, and k. a speaker for converting said modulated signals amplified to a chime sound.

2. An electronic chime according to claim 1 wherein said at least two audible frequency signals generated by said first frequency divider have a fixed frequency ratio.

3. An electronic chime according to claim 1 wherein said digital modulator performs amplitude modulation of said audible frequency signals so as to attenuate their amplitudes stepwise.

4. An electronic chime according to claim 1 wherein said first frequency divider has a first flip-flop group and second flip-flop group generating a first frequency signal $f_1$ and second and third audible frequency signals $f_2$ and $f_3$.

5. An electronic chime according to claim 4 wherein said second and third audible frequency signals $f_2$ and $f_3$ are of a frequency ratio 5:4.

6. An electronic chime according to claim 1 wherein said digital modulator comprises an amplifying transistor to which said audible frequency signals $f_2$ and $f_3$ are alternately applied, an output transistor to which an output of said amplifying transistor is applied and a plurality of transistors to which said plurality of signals from said second frequency divider are applied to the respective bases and the respective collectors of said plurality of transistors are connected with the base of said output transistor through respective resistors.

7. An electronic chime according to claim 6 wherein the resistance values of said resistors connected with the respective collectors of said plurality of transistors are such that the resistance value of the collector resistor of the transistor in the rear stage is twice as high as of the collector resistor of the transistor in the front stage.

8. An electric chime according to claim 1 wherein said switching circuit comprises a first switching transistor inserted between the current source and the load side of the circuit, a second switching transistor connected with the base of said first transistor to switch said transistor on and off, a third switching transistor inserted between the base of said second transistor and the current source to be switched on by a setting pulse responsive to a closing actuation of the push button and a fourth transistor to switch said third transistor off with a resetting pulse from said second frequency divider.

9. An electronic chime according to claim 1 wherein said selective controlling circuit arranges said audible frequency signals alternately at a fixed cycle.

10. An electronic chime comprising:

a. a current source, b. a plurality of calling push buttons including means for generating a separate output denoting a particular one of said push buttons actuated, c. a switching circuit connected to said current source and calling push buttons for feeding a supply voltage to all attached component circuits responsive to said output denoting at least one of said push buttons actuated and interrupting said supply voltage upon receiving a resetting signal, d. an oscillating circuit for generating a standard frequency clock pulse upon receiving the supply voltage, e. a first frequency divider for generating at least two signals of different audible frequencies upon receiving said clock pulse from said oscillating circuit, f. an initial condition determining circuit for generating a one-shot pulse signal upon actuation of the push button, g. a second frequency divider receiving said at least two signals from said first frequency divider and said one-shot pulse signal from said initial condition determining circuit and generating a plurality of rhythm determining pulse signals corresponding in number to the plurality of push buttons and a plurality of digital modulation signals, and further generating said resetting pulse to be applied to said switching circuit after a predetermined number of cycles of said rhythm determining pulse signals, h. a selective controlling circuit receiving said audible frequency signals from said first frequency divider and said rhythm determining pulse signals from said second frequency divider and including means for selecting one of the rhythm determining pulse signals depending on the output denoting the particular push button actuated to alternately arrange the audible frequency signals at a rhythm determined by the selected rhythm determining pulse signal, i. a digital modulator for modulating said alternately arranged audible frequency signals from said selectively controlling circuit in response to said plurality of digital modulation signals from the second frequency divider, j. an amplifier for amplifying said modulated signals from said digital modulator, and k. a speaker for converting said modulated signals amplified to a chime sound.

* * * * *